US006286151B1

(12) United States Patent
Lambertz

(10) Patent No.: US 6,286,151 B1
(45) Date of Patent: Sep. 11, 2001

(54) HEAT-REGULATING SOCK

(75) Inventor: Bodo W. Lambertz, Herdecke (DE)

(73) Assignee: High Teach Institut fur Marketing & Personalentwicklung GmbH (DE)

( * ) Notice: Subject to any disclaimer, the term of this patent is extended or adjusted under 35 U.S.C. 154(b) by 0 days.

(21) Appl. No.: 09/462,300

(22) PCT Filed: Aug. 14, 1998

(86) PCT No.: PCT/DE98/02355

§ 371 Date: Jan. 5, 2000

§ 102(e) Date: Jan. 5, 2000

(87) PCT Pub. No.: WO99/11151

PCT Pub. Date: Mar. 11, 1999

(30) Foreign Application Priority Data

Sep. 3, 1997 (DE) ..... 297 15 762 U

(51) Int. Cl.[7] ..... A43B 17/08
(52) U.S. Cl. ..... 2/239
(58) Field of Search ..... 2/239, 240, 241, 2/242, 455

(56) References Cited

U.S. PATENT DOCUMENTS

| | | | | |
|---|---|---|---|---|
| 294,779 | * | 3/1884 | Goddard | 2/239 |
| 2,283,278 | * | 5/1942 | Morse | 2/240 |
| 3,013,564 | * | 12/1961 | Levey | 128/611 |
| 3,995,322 | * | 12/1976 | Chesebro, Jr. | 2/239 |
| 4,057,981 | | 11/1977 | Runac . | |
| 4,089,064 | * | 5/1978 | Chandler, Jr. | 2/409 |
| 4,126,903 | | 11/1978 | Horton . | |
| 4,206,515 | * | 6/1980 | Robinson | 2/241 |
| 4,255,819 | * | 3/1981 | Klingspor | 2/239 |
| 4,651,354 | * | 3/1987 | Petrey | 2/239 |
| 4,811,727 | * | 3/1989 | Etienne | 128/80 |
| 4,898,007 | * | 2/1990 | Dahlgren | 66/185 |
| 5,095,548 | * | 3/1992 | Chesebro, Jr. | 2/239 |
| 5,263,923 | * | 11/1993 | Fujimoto | 602/62 |
| 5,307,522 | * | 5/1994 | Throneburg et al. | 2/239 |
| 5,353,524 | * | 10/1994 | Brier | 36/55 |
| 5,421,034 | * | 6/1995 | Keune | 2/239 |
| 5,603,232 | * | 2/1997 | Throneburg | 66/185 |
| 5,617,745 | | 4/1997 | Della Corte et al. . | |
| 5,636,380 | | 6/1997 | Schindler et al. . | |
| 5,640,714 | * | 6/1997 | Tanaka | 2/22 |
| 5,675,992 | * | 10/1997 | Wrightenberry | 66/178 R |
| 5,717,996 | * | 2/1998 | Feldmann | 2/22 |
| 5,724,836 | * | 3/1998 | Green | 66/185 |
| 5,768,713 | * | 6/1998 | Crick | 2/409 |
| 5,771,495 | * | 6/1998 | Turner et al. | 2/239 |
| 5,778,702 | * | 7/1998 | Wrightenberry | 66/178 R |
| 5,784,721 | * | 7/1998 | Huff | 2/239 |
| 5,791,163 | * | 8/1998 | Throneburg | 66/178 R |
| 5,898,948 | * | 5/1999 | Kelly et al. | 2/240 |
| 6,012,177 | * | 1/2000 | Cortinovis | 2/239 |
| 6,016,575 | * | 1/2000 | Prychak | 2/239 |
| 6,032,295 | * | 3/2000 | Marshall | 2/239 |
| 6,041,443 | * | 3/2000 | Pas et al. | 2/239 |

FOREIGN PATENT DOCUMENTS

| | | |
|---|---|---|
| 906 201 | 3/1954 | (DE) . |
| 3701834.9 | 5/1987 | (DE) . |
| 90 03 341.8 | 7/1990 | (DE) . |
| 196 18 919 A1 | 7/1997 | (DE) . |
| 0 374 281 A1 | 6/1990 | (EP) . |
| 0 626 140 A | 11/1994 | (EP) . |
| 0 705 543 A1 | 4/1996 | (EP) . |
| 1 192 109 | 10/1959 | (FR) . |

* cited by examiner

*Primary Examiner*—John J. Calvert
*Assistant Examiner*—Alissa L Hoey
(74) *Attorney, Agent, or Firm*—Olson & Hierl, Ltd.

(57) ABSTRACT

The invention relates to a heat-regulating sock (1) with padding in certain areas, worn especially for leisure sports such as jogging, in line skating, skiing and similar. The aim of the invention is to especially provide a means of conducting sweat out of the shoe, to the outside. To this end, the inventive sock has at least one integrated airway (3) extending from the sole (2) to the top of the sock, said airway (3) consisting of heat-regulating netted fabric.

20 Claims, 3 Drawing Sheets

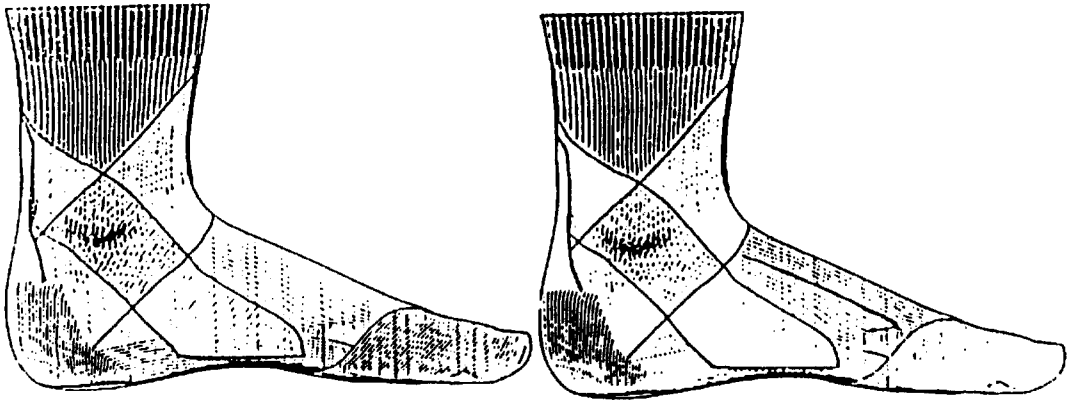
Fig. 2
Fig. 4
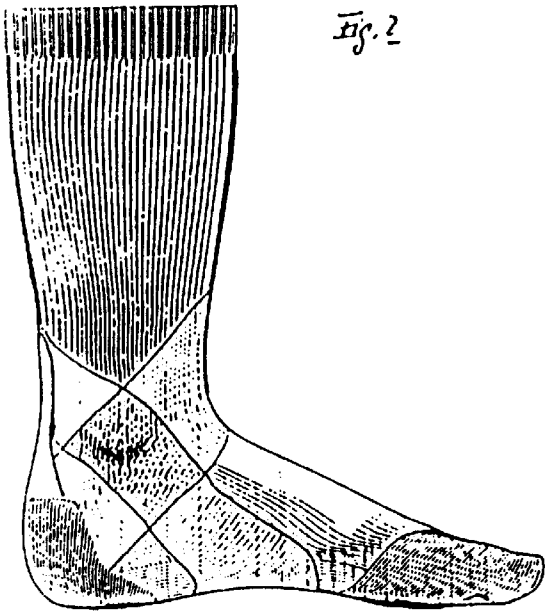
Fig. 3
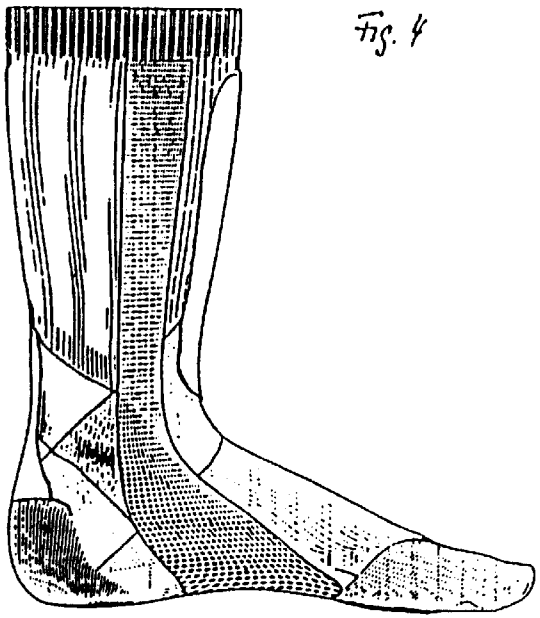
Fig. 5
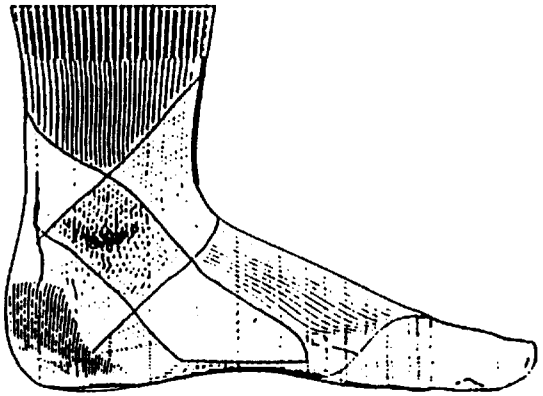
Fig. 6
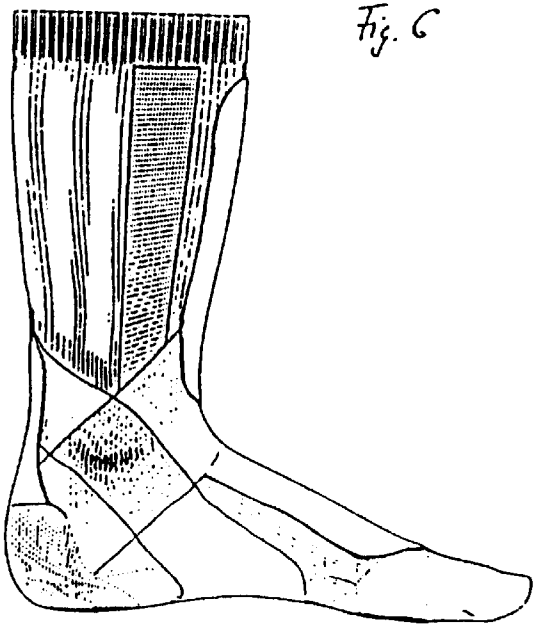
Fig. 7

HEAT-REGULATING SOCK

The invention relates to a climate-adjusting sock with padding provided in various areas, particularly for use in types of leisure sport activities such as jogging, in-line skating, skiing or the like, of the type that has become known from the patent documents EP-A 0 606 140, DE 906 201, DE-A 196 18 919, DE-U 87 01 834, or DE-U 90 03 341, for example.

In all cases in which the human feet are accommodated in comparatively dense footwear, an increased accumulation of sweat is brought about. Beyond normal movements, an accumulation of sweat that is above the average is brought about in types of running movements that strongly stress the feet, such as hiking, football playing, jogging, or the like, as well as during sports cycling. Effort is thus made to make socks that promote the best possible transport of the accumulation of sweat away to the outside available to wearers of shoes.

This requirement for the drawing of the sweat out of and away from the shoe is a particular goal of the present invention, one which is achieved, in accordance with the invention, by means of at least one integrated air channel of a climate-adjusting net-type knit fabric which extends from the sole of the foot up to the band.

A climate channel of an adjusting, net-type knit fabric has the advantage that only about 60% of the surface of the skin is covered, so that the greatest portion of the moisture arising can evaporate through the uncovered portion of the skin, while the rest can be absorbed by the fabric. In addition, such a fabric can also serve for the conveying of the sweat moisture from the area of the soles of the shoe into an area of the sock in which a free evaporation is possible.

It is provided, in this configuration, that an air channel is provided on both outer sides of the sock, that is to say, on the outer side and on the inner side of the leg of the wearer of the sock.

The invention provides that the sock is provided, at least in the area of the instep, with a padded cushion or padding of climate-adjusting fabric, whereby such a padded cushion can serve for the reduction of the pressure points in the area of the laces of the shoe, since the stresses that arise can be distributed over a large surface, and the climate-adjusting fabric serves for the airing of the skin and the transport of the moisture of the sweat away, whereby these fabrics can have different thicknesses, depending on the purpose of use of the sock.

It should be noted at this point that ski socks that use different fabrics in the direct area of the foot, on the one hand, and in the lower calf area, on the other, for example, are already known. It is also known to provide padded cushions or reinforcements in the area of the shins, in order to achieve a better padding in the ski boot or in the football shoe, for example.

Further advantages and specific details of the invention proceed from the other sub-claims, whereby paddings of climate-adjusting fabrics can also be provided in the area of the calf, for example, which can be arranged in rod-shaped, arched, helical, or in other ways, such as a calf-shaped structure or the like.

One exceptional feature of the sock in accordance with the invention can, in an additional configuration, also consist of the fact that it is equipped, in an integrated X-cross support band, with an elastic fabric band, whereby this elastic fabric band consists of climate-adjusting fabric.

For the formation of an anatomically-shaped bed of the foot which takes the differing stresses on the sole of the human foot into consideration, the invention provides for padded cushions or paddings in the area of the toes, the ball of the foot, and/or the heel.

In addition, it can be advantageous to provide a corrugated stretch fabric in the area of the instep, at least in some areas, also with climate-adjusting fabrics of the type of corrugated knit fabric. In this type of knit fabric, the fabric does not lie completely on the skin, as the result of which more air can reach the skin. At the same time, it is brought about, through the type of corrugated knit fabric, that the fabric has a higher elasticity and thereby prevents the formation of folds within the sock, as well as the sliding of the foot within the sock or shoe, which leads to the fact that the formation of blisters comes about less frequently.

The invention will be illustrated in further detail in the following by means of the diagrams.

These depict the following:

FIG. 1: The side view of an example of implementation of a sock in accordance with the invention;

FIGS. 2 to 7: Alternative examples of implementation of socks for different purposes of use; as well as:

FIG. 8: A side view, similar to FIG. 1, of an additional example of implementation.

In reference to FIG. 1[(1)]:

(1) /Text at bottom of this page/:

The sock in accordance with the invention, which is designated as a whole by (1), has an air channel (3) proceeding from the sole of the foot, which channel is indicated by the arrow (2) and extends up to the band (4), and is formed of climate-adjusting net-type knit fabric. Through this air channel (3), moisture is drawn off from the area of the sole of the foot in an upward direction. Such a type of air channel (3) can also be provided on the sock, which is not discussed in further detail here.

In the interior of the sock, the sock (1) is equipped with a padded instep cushion or padding (5) and, in the area of the shin, it is equipped with a padded shin cushion (6), whereby the corresponding contours are only indicated in dotted form.

Both the padded instep cushion (5) and the padded shin cushion (6) are of climate-adjusting fabric, whereby different thicknesses of fabric can be provided here.

The area of the Achilles tendon is also protected by means of a padded cushion (7). In order to prevent grazing and blisters, which can be brought about in this area through the friction from the upper edge of the shoe, this padded cushion (7) also consists of a climate-adjusting fabric.

As is evident from the figures, the area of the calf is also provided with padded cushions whereby, in the example depicted, rod-type paddings (8) are provided. The invention is not, in any event, restricted to this form of configuration, and other forms, such as an arched shape or the like, can also be provided here.

As can be seen from the figures, the sock (1) is also provided with an X-cross support band (9) which is formed of an elastic, climate-adjusting fabric, and which supports the locomotor apparatus in the transitional area between the leg and the foot.

In order to guarantee an anatomically-formed foot bed, the sole of the sock is equipped with additional padded cushions or paddings (10 and 11), particularly in the area of the heel and in the area of the ball of the foot and/or in the area of the toes.

Variants of examples of implementation of the sock in accordance with the invention are depicted in FIGS. 2 to 7. Thus, FIG. 2 depicts a tennis sock with an X-cross support band; FIG. 3 depicts a sock for everyday use, whereby the ankle joint is supported; FIG. 4 depicts a shoe for cyclists;

FIG. 5 depicts the ski sock reproduced on a larger scale than in FIG. 1; FIG. 6 depicts a running sock; and FIG. 7 depicts a sock specially designed for skaters. The padded cushion fabric, the paddings, and the other configurations are slightly modified relative to the example of implementation in accordance with FIG. 1, whereby the X-cross support bandaging of the ankle joint, among others, is also in the foreground here.

Additional support bands are depicted in FIG. 8; thus, there is a ring-type support band (12) above the ankle and, below that, an additional support bandaging (13), whereby these support bandagings can have different types of extension and elasticities. It is additionally depicted that a diagonal support bandaging (14) supporting the sole of the foot between the ball of the foot and the heel, which leads to an increased comfort during running and wearing in many cases, can be provided.

It should be additionally noted at this point that the paddings of the sock can consist of hollow-core fibers which are coated with threads of wool or cotton. The hollow-core/plastic threads are particularly effective in damping shocks and pressure.

The bed of the foot is knit from ensheathed micro-fibers, which are extremely supple and reduce the abrasion/skin abrasion. Depending on the requirements, the bed of the foot is 100% micro-fibers, even in the area of the toes and the heel. The Achilles tendon protective pad, which is made of plastic threads or compound fabric and threads or other materials, serves to protect the Achilles tendon. In order to achieve a high stability, the support bands are also woven, or knit, from non-elastic and elastic threads.

The net-type fabric/knit fabric within the 'Air Channel' consists of climate-adjusting hollow-core plastic threads, which are also ensheathed by other plastic, wool and/or cotton threads. A moisture-absorbing and moisture-transport fabric/knit fabric is brought about by this compound thread. The net-type knit fabric/knit fabric ('Air Channel') does not completely cover the skin but, instead, depending on the requirements, leaves portions of the skin uncovered, so that drops of sweat can arise on the skin, which then drip onto the net fabric and are transported away from the same. An increased cold/cooling from evaporation is thereby brought about. Micro-fiber, polyester, and acrylic paddings within the different zones of the foot bring about mechanical, thermal release, or damping and insulation.

The example of implementation of the invention can, of course, be further modified in various ways without departing from its fundamental concept. Thus, the sock can be formed as a left/right sock, the configuration of the padded cushion can diverge from the one depicted here, and the like.

What is claimed is:

1. A climate-adjusting sock (1) having a foot portion with a sole, an intermediate portion extending therefrom, and a band at the top thereof, with padding provided in predetermined areas, especially for use in various types of leisure sports activities, such as jogging, in-line skating, or skiing, characterized by at least one integrated air channel (3), of a climate-adjusting net-type knit fabric, which extends from the sole of the foot portion (2) up to the band (4).

2. A climate-adjusting sock in accordance with claim 1, characterized in that, the air channel (3) is provided on both outer sides of the sock (1).

3. A climate-adjusting sock in accordance with claim 2, characterized in that, the intermediate portion of the sock in the area of the ankle is equipped with an integrated X-cross support band (9) of an elastic fabric band of climate-adjusting fabric for protecting the ankle.

4. A climate-adjusting sock in accordance with claim 1 or 2, characterized in that, the sock (1) is equipped, at least in the area of the instep of the sole, with a padded cushion (5) or padding of climate-adjusting fabric.

5. A climate-adjusting sock in accordance with one of the preceding claims, characterized by a corrugated stretch fabric in the instep area of the sole, whereby the corrugated fabric is formed as a climate-adjusting fabric of the corrugated knit fabric type.

6. A climate-adjusting sock in accordance with one of the preceding claims, characterized in that, the sock is equipped with a padded cushion (6, 7) or padding of climate-adjusting fabric in the area of the Achilles tendon.

7. A climate-adjusting sock in accordance with claim 6, wherein a padded cushion of climate-adjusting fabric is provided in the area of the shin.

8. A climate-adjusting sock in accordance with one of the preceding claims, characterized in that, the calf area of the sock is equipped with padded cushions (8) of climate-adjusting fabric.

9. A climate-adjusting sock in accordance with claim 8, characterized in that, the padded cushions (8) of the calf area are configured as rods, arches or spirals.

10. A climate-adjusting sock in accordance with claim 1, characterized in that the intermediate portion of the sock is provided in the area of the ankle with an integrated X-cross support band (9) of an elastic fabric band of climate-adjusting fabric for protecting the ankle.

11. A climate-adjusting sock in accordance with claim 10, characterized in that the sole of the sock is provided with an anatomically formed foot bed, which is formed by padded cushions in the area of the toes and the heel.

12. A climate-adjusting sock (1) having a foot portion with a sole, an intermediate portion extending therefrom, and a band at the top thereof, with padding provided in various area for use in various types of leisure sport activities such as jogging, in-line skating, or skiing, characterized in that the intermediate portion of the sock in the area of the ankle is equipped with an integrated X-cross support band (9) of an elastic fabric band of climate-adjusting fabric for protecting the ankle.

13. A climate-adjusting sock in accordance with claim 12, characterized in that, the sole of the sock is provided in the area of the ankle with an anatomically-formed foot bed which is formed by padded cushions (11, 10) or paddings in the area of the toes and the heel.

14. A climate-adjusting sock in accordance with one of the preceding claims, characterized in that, the padded cushions (5) are formed of hollow-core fibers, which are coated with threads of wool or cotton.

15. A climate-adjusting sock in accordance with one of the preceding claims, characterized in that, the foot bed of the sole is knit from ensheathed micro-fibers.

16. A climate-adjusting sock in accordance with one of the preceding claims, characterized in that, the padded cushion (7) is, in the area of the Achilles tendon, formed from plastic threads and/or a compound fabric.

17. A climate-adjusting sock in accordance with one of the preceding claims, characterized in that, the sock is provided, in the area of the ankle joint, with at least one encircling support bandaging.

18. A climate-adjusting sock in accordance with one of the preceding claims, characterized in that, the area of the sole of the foot is provided with a diagonal support fabric.

19. A climate-adjusting sock (1) having a foot portion with a sole, an intermediate portion extending from the sole and a band at the top of the intermediate portion, with padding provided in predetermined areas of the sock, especially for use in various types of leisure sports activities, such as jogging, in-line skating, or skiing, characterized by at least one air channel (3), of a climate-adjusting net-type fabric, which extends from the area of the sole upwardly into the intermediate portion toward the band.

20. A climate-adjusting sock in accordance with claim 19, characterized in that the intermediate portion of the sock in the area of the ankle is provided with an integrated X-cross support band (9) of an elastic fabric band of climate-adjusting fabric for protecting the ankle.

* * * * *

UNITED STATES PATENT AND TRADEMARK OFFICE

CERTIFICATE OF CORRECTION

PATENT NO. : 6,286,151 B1
DATED : September 11, 2001
INVENTOR(S) : Lambertz

It is certified that error appears in the above-identified patent and that said Letters Patent is hereby corrected as shown below:

See ABSTRACT
See Specification

(12) United States Patent
Lambertz

(10) Patent No.: US 6,286,151 B1
(45) Date of Patent: Sep. 11, 2001

(54) HEAT-REGULATING SOCK

(75) Inventor: Bodo W. Lambertz, Herdecke (DE)

(73) Assignee: High Teach Institut fur Marketing & Personalentwicklung GmbH (DE)

( * ) Notice: Subject to any disclaimer, the term of this patent is extended or adjusted under 35 U.S.C. 154(b) by 0 days.

(21) Appl. No.: 09/462,300

(22) PCT Filed: Aug. 14, 1998

(86) PCT No.: PCT/DE98/02355

§ 371 Date: Jan. 5, 2000

§ 102(e) Date: Jan. 5, 2000

(87) PCT Pub. No.: WO99/11151

PCT Pub. Date: Mar. 11, 1999

(30) Foreign Application Priority Data

Sep. 3, 1997 (DE) ..... 297 15 762 U

(51) Int. Cl.[7] ..... A43B 17/08

(52) U.S. Cl. ..... 2/239

(58) Field of Search ..... 2/239, 240, 241, 2/242, 455

(56) References Cited

U.S. PATENT DOCUMENTS

| | | | | |
|---|---|---|---|---|
| 294,779 | * | 3/1884 | Goddard | 2/239 |
| 2,283,278 | * | 5/1942 | Moses | 2/240 |
| 3,013,564 | * | 12/1961 | Levey | 128/611 |
| 3,995,522 | * | 12/1976 | Chesebro, Jr. | 2/239 |
| 4,057,981 | | 11/1977 | Runac . | |
| 4,089,064 | * | 5/1978 | Chandler, Jr. | 2/409 |
| 4,126,908 | | 11/1978 | Hoxton . | |
| 4,205,515 | * | 6/1980 | Robinson | 2/241 |
| 4,255,819 | * | 3/1981 | Klingspor | 2/239 |
| 4,651,354 | * | 3/1987 | Petrey | 2/239 |
| 4,811,727 | * | 3/1989 | Bibeau | 128/80 |
| 4,898,007 | * | 2/1990 | Dahlgren | 66/185 |
| 5,095,548 | * | 3/1992 | Chesebro, Jr. | 2/239 |
| 5,263,923 | * | 11/1993 | Fujimoto | 602/62 |
| 5,307,522 | * | 5/1994 | Throneburg et al. | 2/239 |
| 5,353,524 | * | 10/1994 | Brier | 36/55 |
| 5,421,034 | * | 6/1995 | Keane | 2/239 |
| 5,605,232 | * | 2/1997 | Throneburg | 66/185 |
| 5,617,745 | | 4/1997 | Della Corte et al. | |
| 5,636,380 | | 6/1997 | Schindler et al. . | |
| 5,640,714 | * | 6/1997 | Tanaka | 2/22 |
| 5,675,992 | * | 10/1997 | Wrightsberry | 66/178 R |
| 5,717,996 | * | 2/1998 | Feldmann | 2/22 |
| 5,724,836 | * | 3/1998 | Green | 66/185 |
| 5,768,713 | * | 6/1998 | Chick | 2/409 |
| 5,771,495 | * | 6/1998 | Turner et al. | 2/239 |
| 5,778,702 | * | 7/1998 | Wrightsberry | 66/178 R |
| 5,784,721 | * | 7/1998 | Hall | 2/239 |
| 5,791,163 | * | 8/1998 | Throneburg | 66/178 R |
| 5,898,948 | * | 5/1999 | Kelly et al. | 2/240 |
| 6,012,177 | * | 1/2000 | Corkinovis | 2/239 |
| 6,016,575 | * | 1/2000 | Pyschak | 2/239 |
| 6,032,295 | * | 3/2000 | Marshall | 2/239 |
| 6,041,443 | * | 3/2000 | Fox et al. | 2/239 |

FOREIGN PATENT DOCUMENTS

| | | |
|---|---|---|
| 906 201 | 3/1954 | (DE) . |
| 3701834.9 | 5/1987 | (DE) . |
| 90 09 341.8 | 7/1990 | (DE) . |
| 196 18 919 A1 | 7/1997 | (DE) . |
| 0 374 281 A1 | 6/1990 | (EP) . |
| 0 626 140 A | 11/1994 | (EP) . |
| 0 705 543 A1 | 4/1996 | (EP) . |
| 1 192 109 | 10/1959 | (FR) . |

* cited by examiner

*Primary Examiner*—John J. Calvert
*Assistant Examiner*—Alissa L. Hoey
(74) *Attorney, Agent, or Firm*—Olson & Hierl, Ltd.

(57) ABSTRACT

The invention relates to a heat-regulating sock (1) with padding in certain areas, worn especially for leisure sports such as jogging, in line skating, skiing and similar. The aim of the invention is to especially provide a means of conducting sweat out of the shoe, to the outside. To this end, the inventive sock has at least one integrated airway (3) extending from the sole (2) to the top of the sock, said airway (3) consisting of heat-regulating netted fabric.

20 Claims, 3 Drawing Sheets

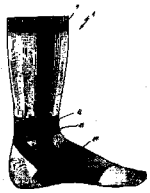

Signed and Sealed this

Seventeenth Day of February, 2004

Jon W. Dudas

JON W. DUDAS
*Acting Director of the United States Patent and Trademark Office*

(12) United States Patent
Lambertz

(10) Patent No.: US 6,286,151 B1
(45) Date of Patent: Sep. 11, 2001

(54) HEAT-REGULATING SOCK

(75) Inventor: Bodo W. Lambertz, Herdecke (DE)

(73) Assignee: High Teach Institut fur Marketing & Personalentwicklung GmbH (DE)

( * ) Notice: Subject to any disclaimer, the term of this patent is extended or adjusted under 35 U.S.C. 154(b) by 0 days.

(21) Appl. No.: 09/462,300

(22) PCT Filed: Aug. 14, 1998

(86) PCT No.: PCT/DE98/02355

§ 371 Date: Jan. 5, 2000

§ 102(e) Date: Jan. 5, 2000

(87) PCT Pub. No.: WO99/11151

PCT Pub. Date: Mar. 11, 1999

(30) Foreign Application Priority Data

Sep. 3, 1997 (DE) ..... 297 15 762 U

(51) Int. Cl.[7] ..... A43B 17/08
(52) U.S. Cl. ..... 2/239
(58) Field of Search ..... 2/239, 240, 241, 2/242, 455

(56) References Cited

U.S. PATENT DOCUMENTS

| | | | | |
|---|---|---|---|---|
| 294,779 | * | 3/1884 | Goddard | 2/239 |
| 2,283,278 | * | 5/1942 | Morse | 2/240 |
| 3,013,564 | * | 12/1961 | Levey | 128/611 |
| 3,995,322 | * | 12/1976 | Chesebro, Jr. | 2/239 |
| 4,057,981 | | 11/1977 | Runac . | |
| 4,089,064 | * | 5/1978 | Chandler, Jr. | 2/409 |
| 4,126,903 | | 11/1978 | Horton . | |
| 4,206,515 | * | 6/1980 | Robinson | 2/241 |
| 4,255,819 | * | 3/1981 | Klingspor | 2/239 |
| 4,651,354 | * | 3/1987 | Petrey | 2/239 |
| 4,811,727 | * | 3/1989 | Etienne | 128/80 |
| 4,898,007 | * | 2/1990 | Dahlgren | 66/185 |
| 5,095,548 | * | 3/1992 | Chesebro, Jr. | 2/239 |
| 5,263,923 | * | 11/1993 | Fujimoto | 602/62 |
| 5,307,522 | * | 5/1994 | Throneburg et al. | 2/239 |
| 5,353,524 | * | 10/1994 | Brier | 36/55 |
| 5,421,034 | * | 6/1995 | Keune | 2/239 |
| 5,603,232 | * | 2/1997 | Throneburg | 66/185 |
| 5,617,745 | | 4/1997 | Della Corte et al. | |
| 5,636,380 | | 6/1997 | Schindler et al. . | |
| 5,640,714 | * | 6/1997 | Tanaka | 2/22 |
| 5,675,992 | * | 10/1997 | Wrightenberry | 66/178 R |
| 5,717,996 | * | 2/1998 | Feldmann | 2/22 |
| 5,724,836 | * | 3/1998 | Green | 66/185 |
| 5,768,713 | * | 6/1998 | Crick | 2/409 |
| 5,771,495 | * | 6/1998 | Turner et al. | 2/239 |
| 5,778,702 | * | 7/1998 | Wrightenberry | 66/178 R |
| 5,784,721 | * | 7/1998 | Huff | 2/239 |
| 5,791,163 | * | 8/1998 | Throneburg | 66/178 R |
| 5,898,948 | * | 5/1999 | Kelly et al. | 2/240 |
| 6,012,177 | * | 1/2000 | Cortinovis | 2/239 |
| 6,016,575 | * | 1/2000 | Prychak | 2/239 |
| 6,032,295 | * | 3/2000 | Marshall | 2/239 |
| 6,041,443 | * | 3/2000 | Pas et al. | 2/239 |

FOREIGN PATENT DOCUMENTS

| | | |
|---|---|---|
| 906 201 | 3/1954 | (DE) . |
| 3701834.9 | 5/1987 | (DE) . |
| 90 03 341.8 | 7/1990 | (DE) . |
| 196 18 919 A1 | 7/1997 | (DE) . |
| 0 374 281 A1 | 6/1990 | (EP) . |
| 0 626 140 A | 11/1994 | (EP) . |
| 0 705 543 A1 | 4/1996 | (EP) . |
| 1 192 109 | 10/1959 | (FR) . |

* cited by examiner

*Primary Examiner*—John J. Calvert
*Assistant Examiner*—Alissa L Hoey
(74) *Attorney, Agent, or Firm*—Olson & Hierl, Ltd.

(57) ABSTRACT

The invention relates to a heat-regulating sock (1) with padding in certain areas, worn especially for leisure sports such as jogging, in line skating, skiing and similar. The aim of the invention is to especially provide a means of conducting sweat out of the shoe, to the outside. To this end, the inventive sock has at least one integrated airway (3) extending from the sole (2) to the top of the sock, said airway (3) consisting of heat-regulating netted fabric.

20 Claims, 3 Drawing Sheets

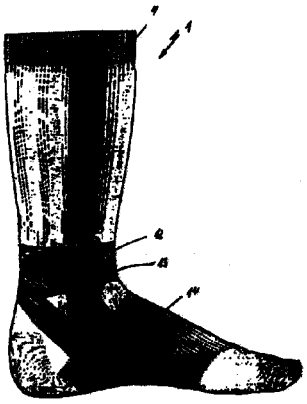

HEAT-REGULATING SOCK

TECHNICAL FIELD OF THE INVENTION

This invention relates to a climate-adjusting sock with padding in various areas.

BACKGROUND OF THE INVENTION

The invention relates to a climate-adjusting sock with padding provided in various areas, particularly for use in types of leisure sport activities such as jogging, in-line skating, skiing or the like, of the type that has become known from the patent documents EP-A 0 606 140, DE 906 201, DE-A 196 18 919, DE-U 87 01 834, or DE-U 90 03 341, for example.

In all cases in which the human feet are accommodated in comparatively dense footwear, an increased accumulation of sweat is brought about. Beyond normal movements, an accumulation of sweat that is above the average is brought about in types of running movements that strongly stress the feet, such as hiking, football playing, jogging, or the like, as well as during sports cycling. Effort is thus made to make socks that promote the best possible transport of the accumulation of sweat away to the outside available to wearers of shoes.

This requirement for the drawing of the sweat out of and away from the shoe is a particular goal of the present invention, one which is achieved, in accordance with the invention, by means of at least one integrated air channel of a climate-adjusting net-type knit fabric which extends from the sole of the foot up to the band.

A climate channel of an adjusting, net-type knit fabric has the advantage that only about 60% of the surface of the skin is covered, so that the greatest portion of the moisture arising can evaporate through the uncovered portion of the skin, white the rest can be absorbed by the fabric. In addition, such a fabric can also serve for the conveying of the sweat moisture from the area of the soles of the shoe into an area of the sock in which a free evaporation is possible.

It is provided, in this configuration, that an air channel is provided on both outer sides of the sock, that is to say, on the outer side and on the inner side of the leg of the wearer of the sock.

The invention provides that the sock is provided, at least in the area of the instep, with a padded cushion or padding of climate-adjusting fabric, whereby such a padded cushion can serve for the reduction of the pressure points in the area of the laces of the shoe, since the stresses that arise can be distributed over a large surface, and the climate-adjusting fabric serves for the airing of the skin and the transport of the moisture of the sweat away, whereby these fabrics can have different thicknesses, depending on the purpose of use of the sock.

It should be noted at this point that ski socks that use different fabrics in the direct area of the foot, on the one hand, and in the tower calf area, on the other, for example, are already known. It is also known to provide padded cushions or reinforcements in the area of the shins, in order to achieve a better padding in the ski boot or in the football shoe, for example.

Further advantages and specific details of the invention proceed from providing paddings of climate-adjusting fabrics in the area of the calf, for example, which can be arranged in rod-shaped, arched, helical, or in other ways, such as a calf-shaped structure or the like.

One exceptional feature of the sock in accordance with the invention can, in an additional configuration, also consist, of the fact that it is equipped, in an integrated X-cross support band, with an elastic fabric band, whereby this elastic fabric band consists of climate-adjusting fabric.

For the formation of an automatically-shaped bed of the foot which takes the differing stresses on the sole of the human foot into consideration, the invention provides for padded cushions or paddings in the area of the toes, the ball of the foot, and/or the heel.

In addition, it can be advantageous to provide a corrugated stretch fabric in the area of the instep, at least in some areas, also with climate-adjusting fabrics of the type of corrugated knit fabric. In this type of knit fabric, the fabric does not lie completely on the skin, as the result of which more air can reach the skin. At the same time, it is brought about, through the type of corrugated knit fabric, that the fabric has a higher elasticity and thereby prevents the formation of folds within the sock, as well as the sliding of the foot within the sock or shoe, which leads to the fact that, the formation of blisters comes about less frequently.

BRIEF DESCRIPTION OF THE DRAWINGS

The invention will be illustrated in further detail in the following drawing which depict the following.

DETAILED DESCRIPTION OF THE INVENTION

Figure 1:
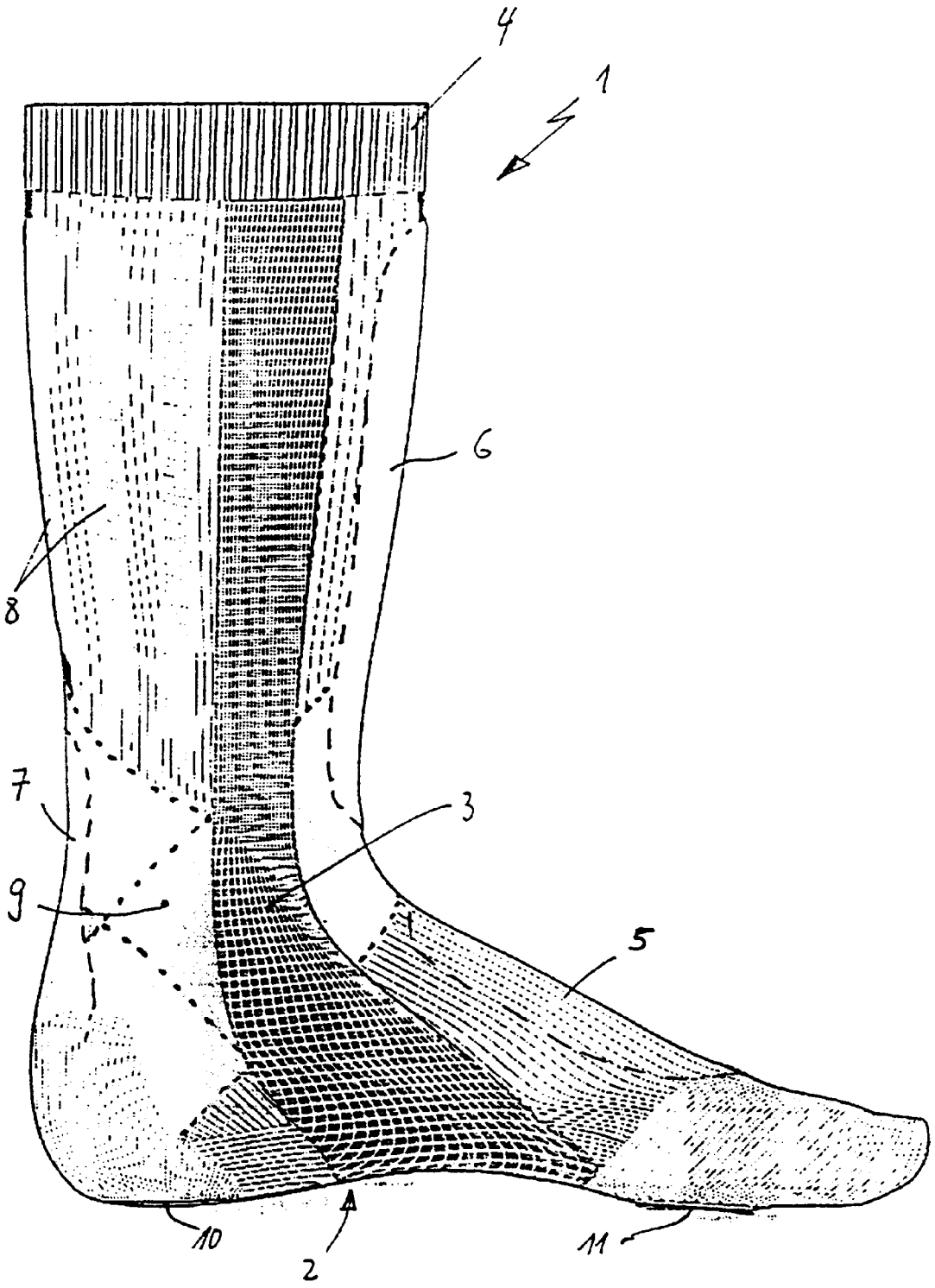
FIG. 1 is a side view of an example of implementation of a sock in accordance with the invention.

In reference to FIG. 1, the sock in accordance with the invention, which is designated as a whole by (1), has an air channel (3) proceeding from the sole of the foot which channel is indicated by the arrow (2) and extends up to the band (4), and is formed of climate-adjusting net-type knit fabric. Through this air channel (3), moisture is drawn off from the area of the sole of the foot in an upward direction. Such a type of air channel (3) can also be provided on the inside surface of the sock, which is not discussed in further detail here.

In the interior of the sock, the sock (1) is equipped with a padded instep cushion or padding (5) and, in the area of the shin, it is equipped with a padded shin cushion (6), whereby the corresponding contours are only indicated in dotted form.

Both the padded instep cushion (5) and the padded shin cushion (6) are of climate-adjusting fabric, whereby different thicknesses of fabric can be provided here.

The area of the Achilles tendon is also protected by means of a padded cushion (7). In order to prevent grazing and blisters, which can be brought about in this area through the friction from the upper edge of the shoe, this padded cushion (7) also consists of a climate-adjusting fabric. Examples of suitable climate-adjusting fabrics are COOLMAX fabric and THERMASTAT fabric, both made by E.I. duPont de Nemours and Company.

As is evident from the figures, the area of the calf is also provided with padded cushions whereby, in the example depicted, rod-type paddings (8) are provided. The invention is not, in any event, restricted to this form of configuration, and other forms, such as an arched shape or the like, can also be provided here.

As can be seen from the figures, the sock (1) is also provided with an X-cross support band (9) which is formed of an elastic, climate-adjusting fabric, and which supports the motion apparatus in the transitional area between the leg and the foot.

In order to guarantee an anatomically-formed that bed, the sole of the sock is equipped with additional padded cushions or paddings (10 and 11), particularly in the area of the heel and in the area of the ball of the foot and/or in the area of the toes.

Figures 2, 3, 4, 5, 6, 7:
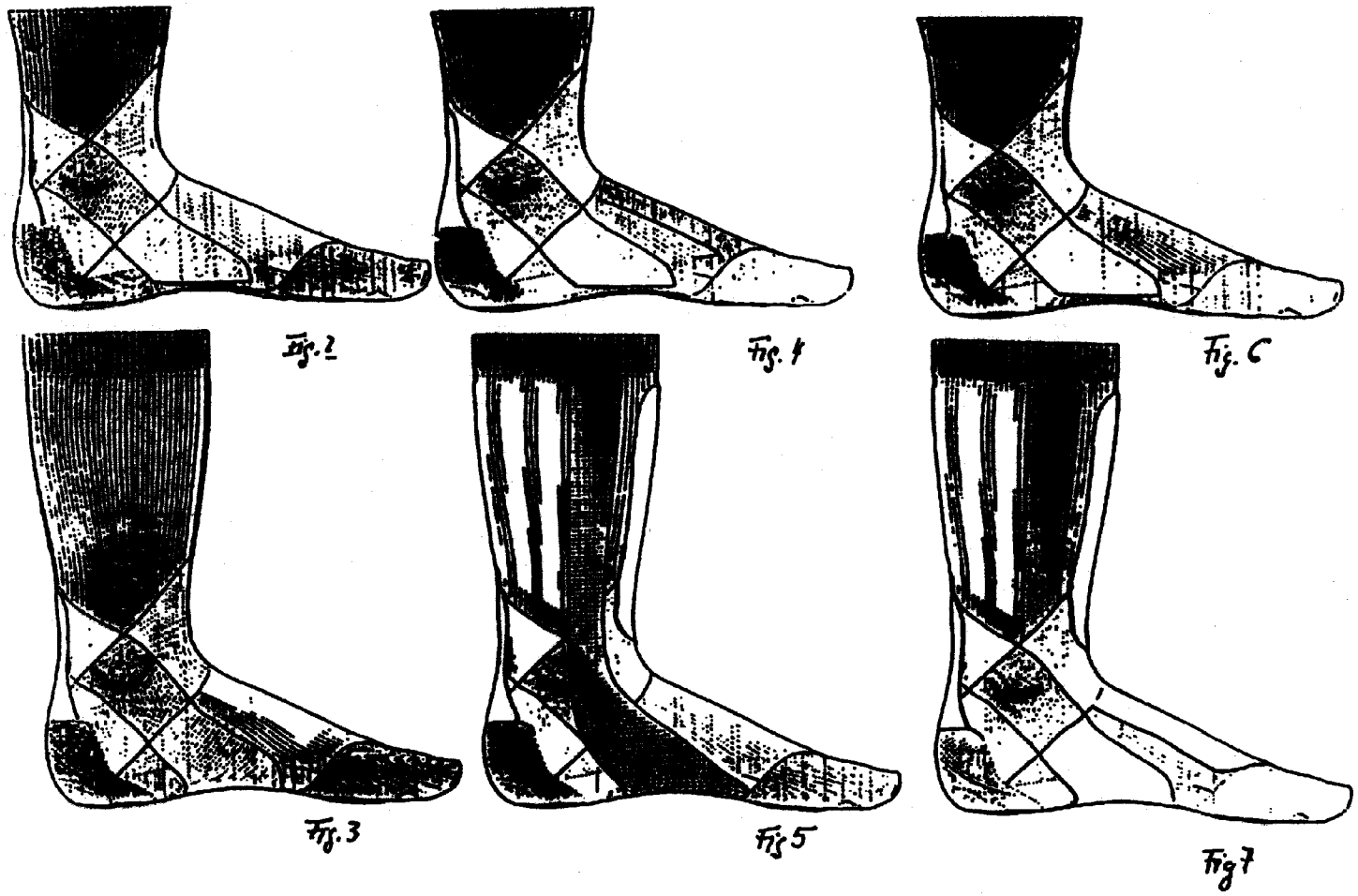
FIGS. 2–7 are alternative examples of implementation of socks for different purposes of use.
Figure 8:
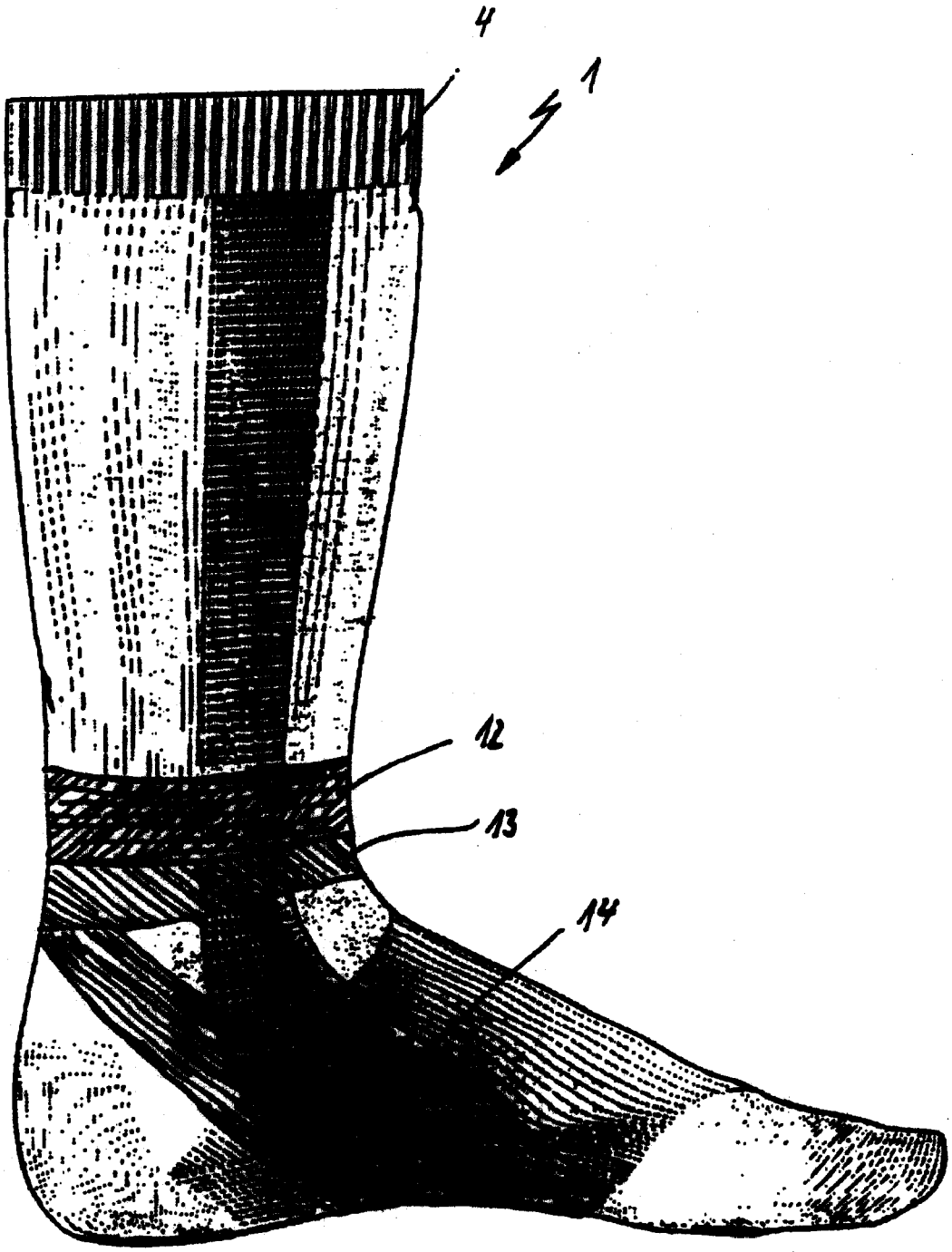
Figure 1:
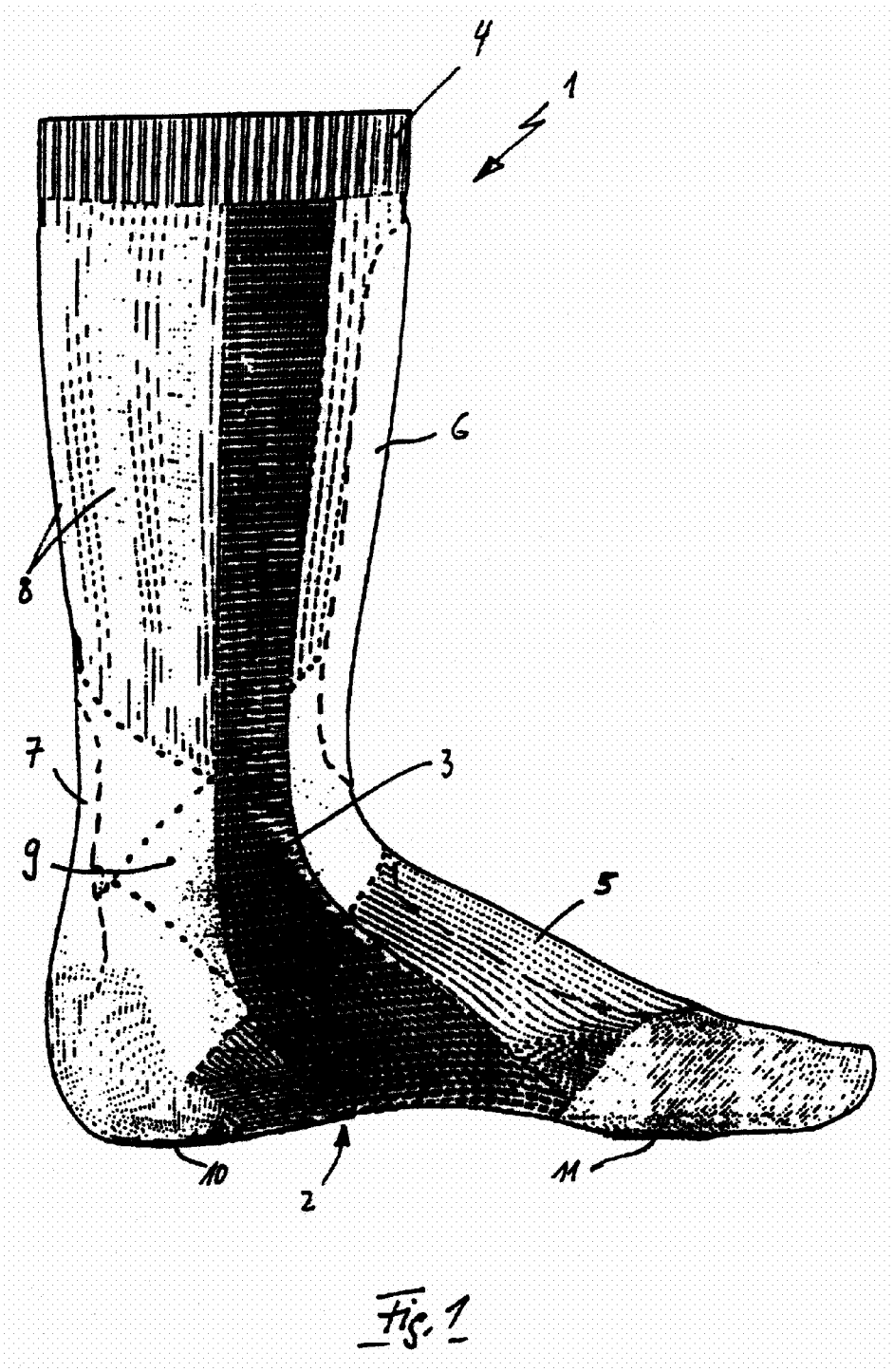
Figures 2, 3, 4, 5, 6, 7:
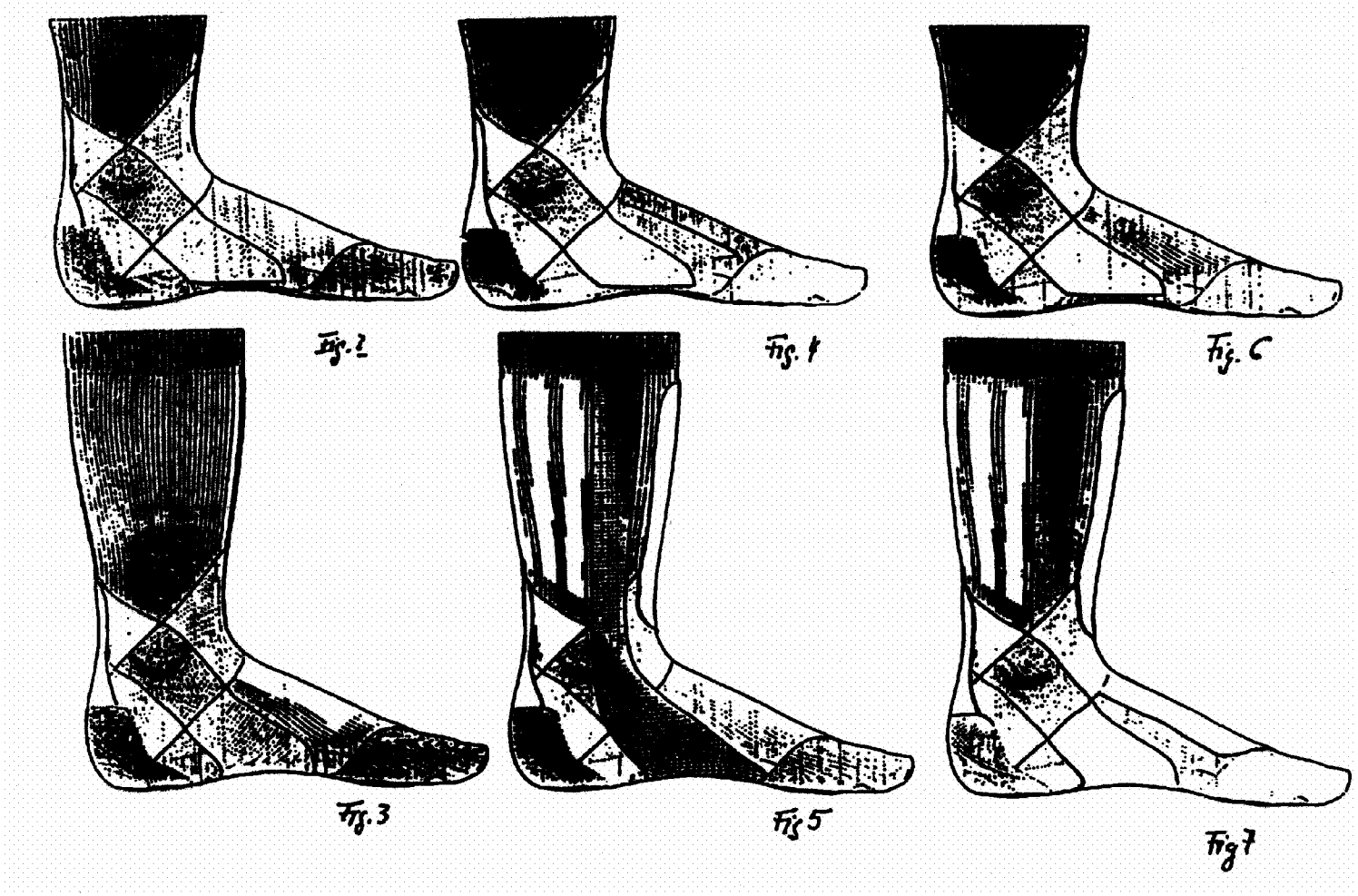
Figure 8:
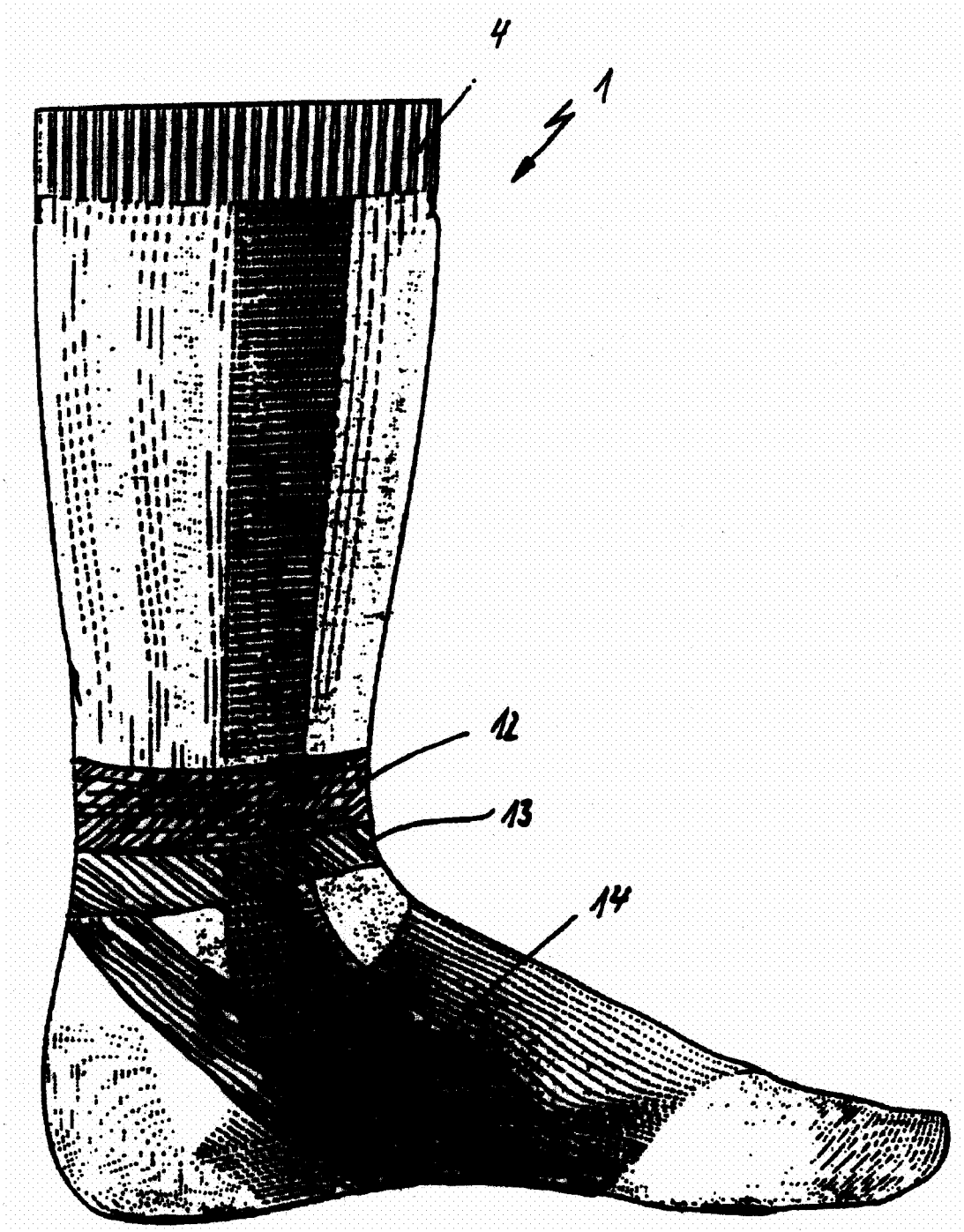

Variants of examples of implementation of the sock in accordance with the invention are depicted in FIGS. 2 to 7. Thus, FIG. 2 depicts a tennis sock with an X-cross support band; FIG. 3 depicts a sock for everyday use, whereby the ankle joint is supported; FIG. 4 depicts a shoe for cyclists; FIG. 5 depicts the ski sock reproduced on a larger scale than in FIG. 1; FIG. 6 depicts a running sock; and FIG. 7 depicts a sock specially designed for skaters. The padded cushion fabric, the paddings, and the other configurations are slightly modified relative to the example of implementation in accordance with FIG. 1, whereby the X-cross support bandaging of the ankle joint, among others, is also in the foreground here.

Figure 8:
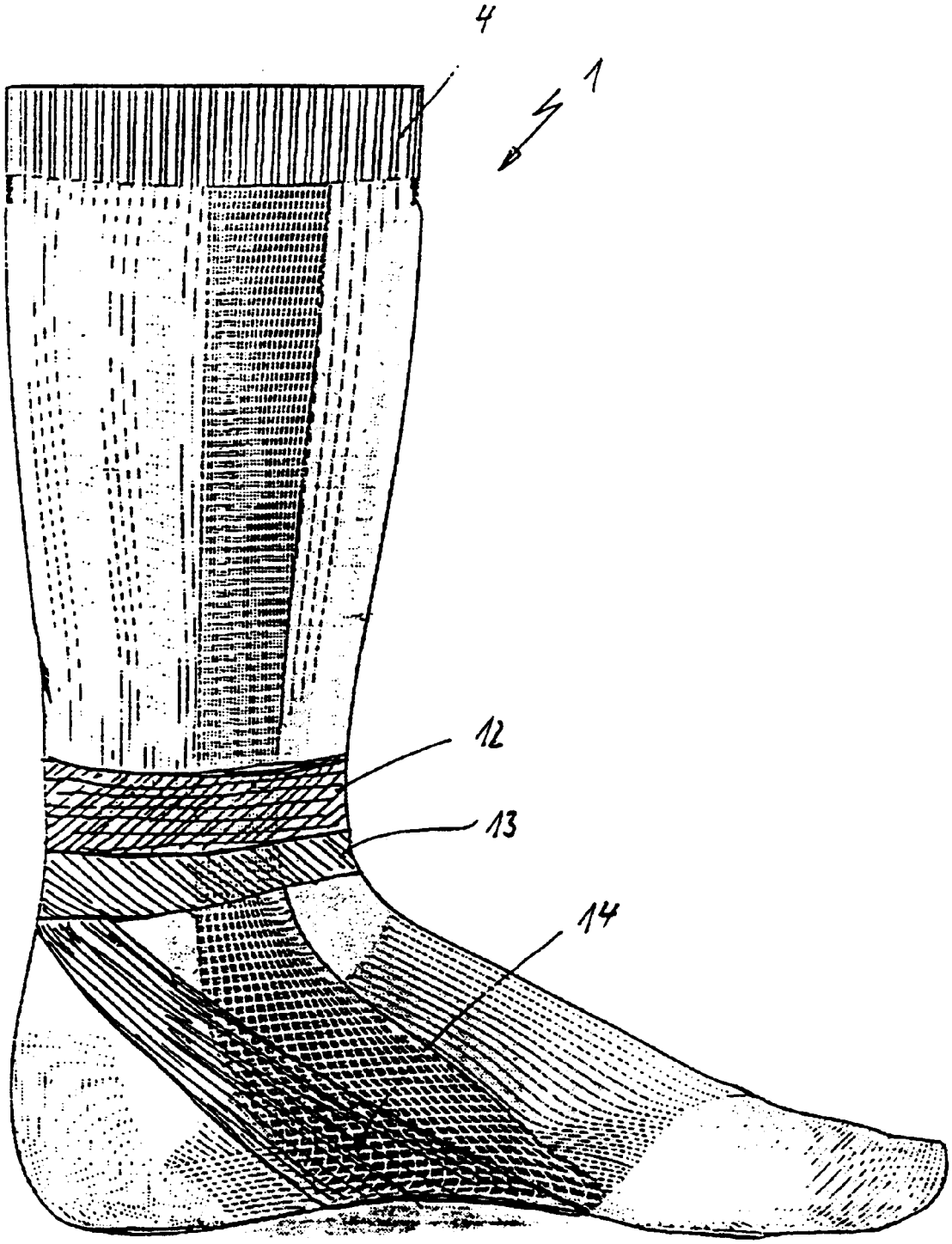
FIG. 8 is a side view, similar to FIG. 1, of an additional example or implementation.
Figure 1:
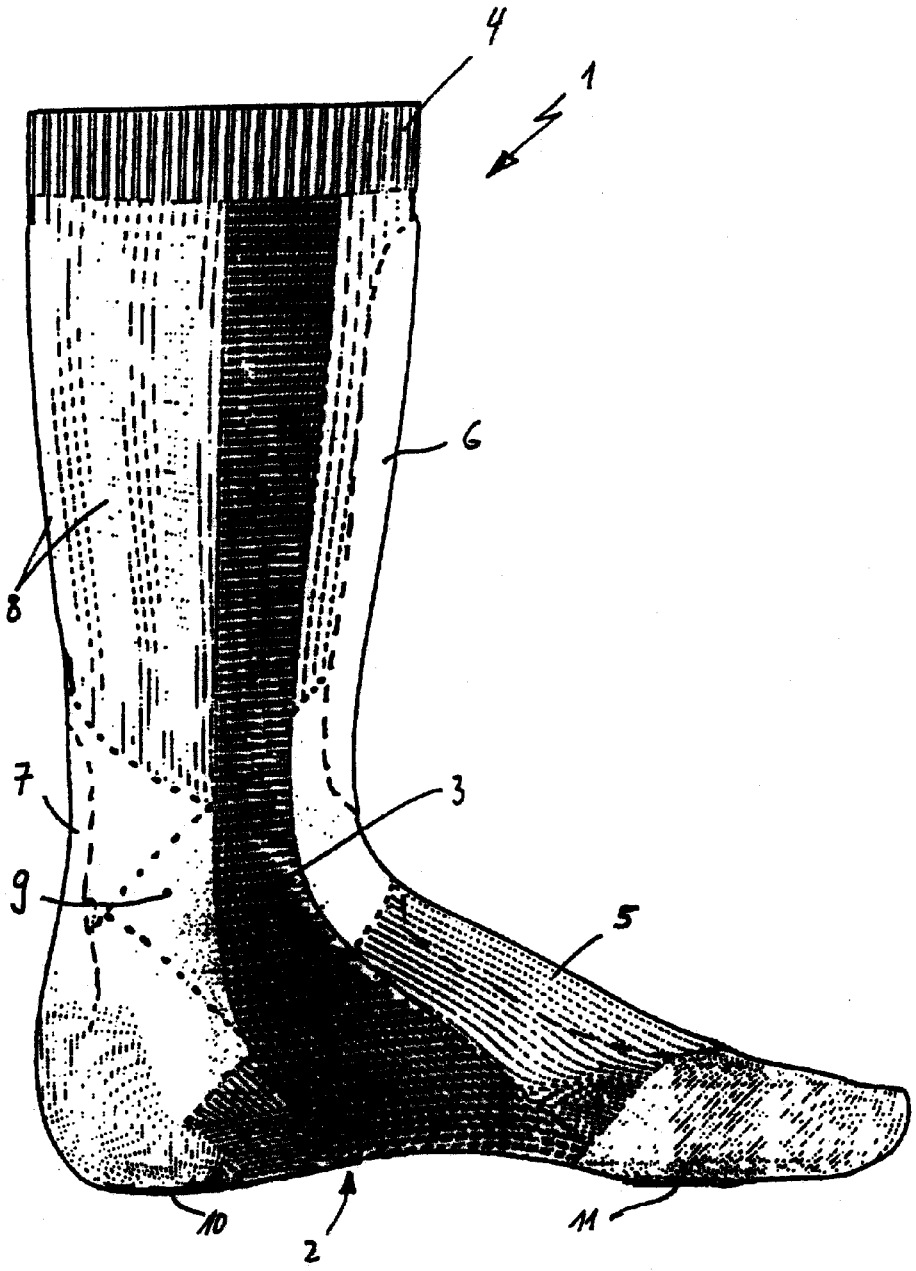

Additional support bands are depicted in FIG. 8; thus, there is a ring-type support band (12) above the ankle and, below that, an additional support bandaging (13), whereby these support bandagings can have different types of extension and elasticities. It is additionally depicted that a diagonal support bandaging (14) supporting the sole of the foot between the ball of the foot and the heel, which leads to an increased comfort during running and wearing in many cases, can be provided.

It should be additionally noted at this point that the paddings of the sock can consist of hollow-core fibers which are coated with threads of wool or cotton. The hollow-core/plastic threads are particularly effective in damping shocks and pressure. The hollow core fibers provide insulating air space within the fibers and one specific example is THERMAX fabric of E.I. duPont de Nemours and Company.

The bed of the foot is knit from ensheathed micro-fibers, which are extremely supple and reduce the abrasion/skin abrasion. Depending on the requirements, the bed of the foot is 100% micro-fibers, even in the area of the toes and the heel. The Achilles tendon protective pad, which is made of plastic threads or compound fabric and threads or other materials, serves to protect the Achilles tendon. In order to achieve a high stability, the support bands are also woven, or knit, from non-elastic and elastic threads.

The net or mesh-type fabric/knit fabric within the 'Air Channel' consists of climate-adjusting hollow-core plastic threads, which are also ensheathed by other plastic, such as nylon or spandex, wool and/or cotton threads. A moisture-absorbing and moisture-transport fabric/knit fabric is brought about by this compound thread. The net or mesh-type knit fabric/knit fabric ('Air Channel') does not completely cover the skin but, instead, depending on the requirements, leaves portions of tile skin uncovered, so that drops of sweat can arise on the skin, which then drip onto the net or mesh fabric and are transported away or wicked away from the same. An increased cold/cooling from evaporation is (hereby brought about, Micro-fiber, polyester, and acrylic paddings within the different zones of the foot bring about mechanical, thermal release, or damping and insulation.

In one example, a sock can be made from COOLMAX® or TACTEL® fibers enclosed in cotton. TACTEL is a product of Imperial Chemical Industrial PLC. Polyester fiber can be added for shock absorbency and elasticity. In another example, the sock could be made from COOLMAX® or THERMASTAT fibers blended with merino wool or silk. In yet another example, KEVLAR® (an aromatic polyamide fiber made by E.I. duPont de Nemours and Company) enhanced with a microfiber and cotton are used. A synthetic fiber, such as LYCRA® (a spandex fiber in the form of continuous monofilaments made by E.I. duPont de Nemours and Company) may be added to provide for elasticity.

The example of implementation of the invention can, of course, be further modified in various ways without departing from its fundamental concept. Thus, the sock can be formed as a left and a right sock, the configuration of the padded cushion can diverge from the one depicted here, and the like.

What is claimed is:

1. A climate-adjusting sock (1) having foot portion with a sole, an intermediate portion extending therefrom, and a band at the top thereof, with padding provided in predetermined areas, for use in various types of leisure sports activities, characterized by at least one integrated air channel (3), of a climate-adjusting net-type knit fabric, which extends from the sole of the foot (2) up to the band (4) for drawing off moisture from the sole area.

2. A climate-adjusting sock in accordance with claim 1, characterized in that, the air channel (3) is provided on both outer sides of the sock (1).

3. A climate-adjusting sock in accordance with claim 2, characterized in that, the intermediate portion of the sock in the area of the ankle is equipped with an integrated X-cross support band (9) of an elastic fabric band of climate-adjusting fabric for supporting the ankle.

4. A climate-adjusting sock in accordance with claim 2, characterized in that, the sock (1) is equipped, at least in the area of the instep of the sole, with a padded cushion (5) or padding of climate-adjusting fabric.

5. A climate-adjusting sock in accordance with claim 4, characterized by a corrugated stretch fabric in the instep area of the sole, whereby the corrugated fabric is formed as a climate-adjusting fabric of the corrugated knit fabric type.

6. A climate-adjusting sock in accordance with claim 5, characterized in that, the sock is equipped with a padded cushion (6, 7) or padding of climate-adjusting fabric in the area of the Achilles tendon.

7. A climate-adjusting sock in accordance with claim 6, wherein a padded cushion of climate-adjusting fabric is provided in the area of the shin.

8. A climate-adjusting sock in accordance with claim 6, characterized in that, the calf area of the sock is equipped with padded cushions (8) of climate-adjusting fabric.

9. A climate-adjusting sock in accordance with claim 8, characterized in that, the padded cushions (8) of the calf area are configured as rods, arches, or spirals.

10. A climate-adjusting sock in accordance with claim 1, rods, arches, or spirals. characterized in that the intermediate portion of the sock is provided in the area of the ankle with an integrated X-cross support band (9) of an elastic fabric band of climate-adjusting fabric for supporting the ankle.

11. A climate-adjusting sock in accordance with claim 10, characterized in that the sole of the sock is provided with an anatomically formed foot bed, which is formed by padded cushions in the area of the toes and the heel.

12. A climate-adjusting sock (1) having a foot portion with a sole, an intermediate portion extending therefrom, and a band at the top thereof, with padding provided in various areas, for use in various types of leisure sport activities, characterized in that the intermediate portion of the sock in the area of the ankle is equipped with an integrated X-cross support hand (9) of an elastic fabric band of climate-adjusting fabric for supporting the ankle.

13. A climate-adjusting sock in accordance with claim 12, characterized in that, the sole of the sock is provided in the area of the ankle with an anatomically-formed foot bed which is formed by padded cushions (11, 10) or paddings in the area of the toes and the heel.

14. A climate-adjusting sock in accordance with claim 13, characterized in that, the padded cushions (5) are formed of hollow-core fibers, which are coated with threads of wool or cotton.

15. A climate-adjusting sock in accordance with claim 14, characterized in that, the foot bed of the sole is knit from ensheathed micro-fibers.

16. A climate-adjusting sock in accordance with claim 15, characterized in that, the padded cushion (7) is, in the area of the Achilles tendon, formed from plastic threads and/or a compound fabric.

17. A climate-adjusting sock in accordance with claim 16, characterized in that, the sock is provided, in the area of the ankle joint, with at least one encircling support bandaging.

18. A climate-adjusting sock in accordance with claim 17, characterized in that, the area of the sole of the foot is provided with a diagonal support fabric.

19. A climate-adjusting sock (1) having a foot portion with a sole, an intermediate portion extending from the sole and a band at the top of the intermediate portion, with padding provided in predetermined areas of the sock, for use in various types of leisure sports activities, characterized by at least one air channel (3), of a climate-adjusting net-type fabric, which extends from the area of the sole upwardly into the intermediate portion toward the band for drawing off moisture from the sole area.

20. A climate-adjusting sock in accordance with claim 19, characterized in that the intermediate portion of the sock in the area of the ankle is provided with an integrated X-cross support band (9) of an elastic fabric hand of climate-adjusting fabric for supporting the ankle.

* * * * *

UNITED STATES PATENT AND TRADEMARK OFFICE

CERTIFICATE OF CORRECTION

PATENT NO. : 6,286,151 B1
DATED : September 11, 2001
INVENTOR(S) : Lambertz

It is certified that error appears in the above-identified patent and that said Letters Patent is hereby corrected as shown below:

See Specification
See Claims

(12) United States Patent
Lambertz

(10) Patent No.: US 6,286,151 B1
(45) Date of Patent: Sep. 11, 2001

(54) HEAT-REGULATING SOCK

(75) Inventor: Bodo W. Lambertz, Herdecke (DE)

(73) Assignee: High Tech Institut fur Marketing & Personalentwicklung GmbH (DE)

( * ) Notice: Subject to any disclaimer, the term of this patent is extended or adjusted under 35 U.S.C. 154(b) by 0 days.

(21) Appl. No.: 09/462,300

(22) PCT Filed: Aug. 14, 1998

(86) PCT No.: PCT/DE98/02355

§ 371 Date: Jan. 5, 2000

§ 102(e) Date: Jan. 5, 2000

(87) PCT Pub. No.: WO99/11151

PCT Pub. Date: Mar. 11, 1999

(30) Foreign Application Priority Data

Sep. 3, 1997 (DE) ..... 297 15 762 U

(51) Int. Cl.[7] ..... A43B 17/08

(52) U.S. Cl. ..... 2/239

(58) Field of Search ..... 2/239, 240, 241, 2/242, 455

(56) References Cited

U.S. PATENT DOCUMENTS

| | | | | |
|---|---|---|---|---|
| 294,779 | * | 3/1884 | Goddard | 2/239 |
| 2,283,278 | * | 5/1942 | Moore | 2/240 |
| 3,013,564 | * | 12/1961 | Levey | 128/611 |
| 3,995,522 | * | 12/1976 | Chesebro, Jr. | 2/239 |
| 4,057,981 | | 11/1977 | Rusac . | |
| 4,089,064 | * | 5/1978 | Chandler, Jr. | 2/409 |
| 4,126,908 | | 11/1978 | Horton . | |
| 4,205,515 | * | 6/1980 | Robinson | 2/241 |
| 4,255,819 | * | 3/1981 | Klingspor | 2/239 |
| 4,651,354 | * | 3/1987 | Petrey | 2/239 |
| 4,811,727 | * | 3/1989 | Bibeau | 128/80 |
| 4,898,007 | * | 2/1990 | Dahlgren | 66/185 |
| 5,095,548 | * | 3/1992 | Chesebro, Jr. | 2/239 |
| 5,263,923 | * | 11/1993 | Fujimoto | 602/62 |
| 5,307,522 | * | 5/1994 | Throneburg et al. | 2/239 |
| 5,353,524 | * | 10/1994 | Brier | 36/55 |
| 5,421,034 | * | 6/1995 | Keane | 2/239 |
| 5,605,231 | * | 2/1997 | Throneburg | 66/185 |
| 5,617,745 | | 4/1997 | Della Corte et al. | |
| 5,636,380 | | 6/1997 | Schindler et al. . | |
| 5,640,714 | * | 6/1997 | Tanaka | 2/22 |
| 5,675,992 | * | 10/1997 | Wrightsberry | 66/178 R |
| 5,717,996 | * | 2/1998 | Feldmann | 2/22 |
| 5,724,836 | * | 3/1998 | Green | 66/185 |
| 5,768,713 | * | 6/1998 | Chick | 2/409 |
| 5,771,495 | * | 6/1998 | Turner et al. | 2/239 |
| 5,778,702 | * | 7/1998 | Wrightsberry | 66/178 R |
| 5,784,721 | * | 7/1998 | Hall | 2/239 |
| 5,791,163 | * | 8/1998 | Throneburg | 66/178 R |
| 5,898,948 | * | 5/1999 | Kelly et al. | 2/240 |
| 6,012,177 | * | 1/2000 | Cortinovis | 2/239 |
| 6,016,575 | * | 1/2000 | Pyschall | 2/239 |
| 6,032,295 | * | 3/2000 | Marshall | 2/239 |
| 6,041,443 | * | 3/2000 | Pur et al. | 2/239 |

FOREIGN PATENT DOCUMENTS

| | | |
|---|---|---|
| 906 201 | 3/1954 | (DE) . |
| 3701834.9 | 5/1987 | (DE) . |
| 90 09 341.8 | 7/1990 | (DE) . |
| 196 18 919 A1 | 7/1997 | (DE) . |
| 0 374 281 A1 | 6/1990 | (EP) . |
| 0 626 140 A | 11/1994 | (EP) . |
| 0 705 545 A1 | 4/1996 | (EP) . |
| 1 192 109 | 10/1959 | (FR) . |

* cited by examiner

*Primary Examiner*—John J. Calvert
*Assistant Examiner*—Alissa L. Hoey
(74) *Attorney, Agent, or Firm*—Olson & Hierl, Ltd.

(57) ABSTRACT

The invention relates to a heat-regulating sock (1) with padding in certain areas, worn especially for leisure sports such as jogging, in line skating, skiing and similar. The aim of the invention is to especially provide a means of conducting sweat out of the shoe, to the outside. To this end, the inventive sock has at least one integrated airway (3) extending from the sole (2) to the top of the sock, said airway (3) consisting of heat-regulating netted fabric.

20 Claims, 3 Drawing Sheets

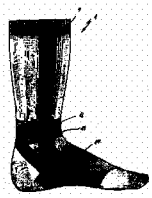

This certificate supersedes Certificate of Correction issued February 17, 2004.

Signed and Sealed this

Second Day of March, 2004

JON W. DUDAS
*Acting Director of the United States Patent and Trademark Office*

(12) United States Patent
Lambertz

(10) Patent No.: US 6,286,151 B1
(45) Date of Patent: Sep. 11, 2001

(54) HEAT-REGULATING SOCK

(75) Inventor: Bodo W. Lambertz, Herdecke (DE)

(73) Assignee: High Teach Institut fur Marketing & Personalentwicklung GmbH (DE)

( * ) Notice: Subject to any disclaimer, the term of this patent is extended or adjusted under 35 U.S.C. 154(b) by 0 days.

(21) Appl. No.: 09/462,300

(22) PCT Filed: Aug. 14, 1998

(86) PCT No.: PCT/DE98/02355

§ 371 Date: Jan. 5, 2000

§ 102(e) Date: Jan. 5, 2000

(87) PCT Pub. No.: WO99/11151

PCT Pub. Date: Mar. 11, 1999

(30) Foreign Application Priority Data

Sep. 3, 1997 (DE) ..... 297 15 762 U

(51) Int. Cl.[7] ..... A43B 17/08
(52) U.S. Cl. ..... 2/239
(58) Field of Search ..... 2/239, 240, 241, 2/242, 455

(56) References Cited

U.S. PATENT DOCUMENTS

| | | | | |
|---|---|---|---|---|
| 294,779 | * | 3/1884 | Goddard | 2/239 |
| 2,283,278 | * | 5/1942 | Morse | 2/240 |
| 3,013,564 | * | 12/1961 | Levey | 128/611 |
| 3,995,322 | * | 12/1976 | Chesebro, Jr. | 2/239 |
| 4,057,981 | | 11/1977 | Runac . | |
| 4,089,064 | * | 5/1978 | Chandler, Jr. | 2/409 |
| 4,126,903 | | 11/1978 | Horton . | |
| 4,206,515 | * | 6/1980 | Robinson | 2/241 |
| 4,255,819 | * | 3/1981 | Klingspor | 2/239 |
| 4,651,354 | * | 3/1987 | Petrey | 2/239 |
| 4,811,727 | * | 3/1989 | Etienne | 128/80 |
| 4,898,007 | * | 2/1990 | Dahlgren | 66/185 |
| 5,095,548 | * | 3/1992 | Chesebro, Jr. | 2/239 |
| 5,263,923 | * | 11/1993 | Fujimoto | 602/62 |
| 5,307,522 | * | 5/1994 | Throneburg et al. | 2/239 |
| 5,353,524 | * | 10/1994 | Brier | 36/55 |
| 5,421,034 | * | 6/1995 | Keune | 2/239 |
| 5,603,232 | * | 2/1997 | Throneburg | 66/185 |
| 5,617,745 | | 4/1997 | Della Corte et al. | |
| 5,636,380 | | 6/1997 | Schindler et al. . | |
| 5,640,714 | * | 6/1997 | Tanaka | 2/22 |
| 5,675,992 | * | 10/1997 | Wrightenberry | 66/178 R |
| 5,717,996 | * | 2/1998 | Feldmann | 2/22 |
| 5,724,836 | * | 3/1998 | Green | 66/185 |
| 5,768,713 | * | 6/1998 | Crick | 2/409 |
| 5,771,495 | * | 6/1998 | Turner et al. | 2/239 |
| 5,778,702 | * | 7/1998 | Wrightenberry | 66/178 R |
| 5,784,721 | * | 7/1998 | Huff | 2/239 |
| 5,791,163 | * | 8/1998 | Throneburg | 66/178 R |
| 5,898,948 | * | 5/1999 | Kelly et al. | 2/240 |
| 6,012,177 | * | 1/2000 | Cortinovis | 2/239 |
| 6,016,575 | * | 1/2000 | Prychak | 2/239 |
| 6,032,295 | * | 3/2000 | Marshall | 2/239 |
| 6,041,443 | * | 3/2000 | Pas et al. | 2/239 |

FOREIGN PATENT DOCUMENTS

| | | |
|---|---|---|
| 906 201 | 3/1954 | (DE) . |
| 3701834.9 | 5/1987 | (DE) . |
| 90 03 341.8 | 7/1990 | (DE) . |
| 196 18 919 A1 | 7/1997 | (DE) . |
| 0 374 281 A1 | 6/1990 | (EP) . |
| 0 626 140 A | 11/1994 | (EP) . |
| 0 705 543 A1 | 4/1996 | (EP) . |
| 1 192 109 | 10/1959 | (FR) . |

* cited by examiner

*Primary Examiner*—John J. Calvert
*Assistant Examiner*—Alissa L Hoey
(74) *Attorney, Agent, or Firm*—Olson & Hierl, Ltd.

(57) ABSTRACT

The invention relates to a heat-regulating sock (1) with padding in certain areas, worn especially for leisure sports such as jogging, in line skating, skiing and similar. The aim of the invention is to especially provide a means of conducting sweat out of the shoe, to the outside. To this end, the inventive sock has at least one integrated airway (3) extending from the sole (2) to the top of the sock, said airway (3) consisting of heat-regulating netted fabric.

20 Claims, 3 Drawing Sheets

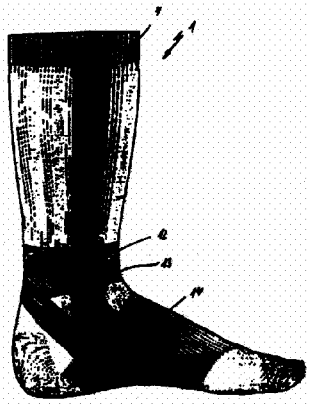

HEAT-REGULATING SOCK

TECHNICAL FIELD OF THE INVENTION

This invention relates to a climate-adjusting sock with padding in various areas.

BACKGROUND OF THE INVENTION

The invention relates to a climate-adjusting sock with padding provided in various areas, particularly for use in types of leisure sport activities such as jogging, in-line skating, skiing or the like, of the type that has become known from the patent documents EP-A 0 606 140, DE 906 201, DE-A 196 18 919, DE-U 87 01 834, or DE-U 90 03 341, for example.

In all cases in which the human feet are accommodated in comparatively dense footwear, an increased accumulation of sweat is brought about. Beyond normal movements, an accumulation of sweat that is above the average is brought about in types of running movements that strongly stress the feet, such as hiking, football playing, jogging, or the like, as well as during sports cycling. Effort is thus made to make socks that promote the best possible transport of the accumulation of sweat away to the outside available to wearers of shoes.

This requirement for the drawing of the sweat out of and away from the shoe is a particular goal of the present invention, one which is achieved, in accordance with the invention, by means of at least one integrated air channel of a climate-adjusting net-type knit fabric which extends from the sole of the foot up to the band.

A climate channel of an adjusting, net-type knit fabric has the advantage that only about 60% of the surface of the skin is covered, so that the greatest portion of the moisture arising can evaporate through the uncovered portion of the skin, white the rest can be absorbed by the fabric. In addition, such a fabric can also serve for the conveying of the sweat moisture from the area of the soles of the shoe into an area of the sock in which a free evaporation is possible.

It is provided, in this configuration, that an air channel is provided on both outer sides of the sock, that is to say, on the outer side and on the inner side of the leg of the wearer of the sock.

The invention provides that the sock is provided, at least in the area of the instep, with a padded cushion or padding of climate-adjusting fabric, whereby such a padded cushion can serve for the reduction of the pressure points in the area of the laces of the shoe, since the stresses that arise can be distributed over a large surface, and the climate-adjusting fabric serves for the airing of the skin and the transport of the moisture of the sweat away, whereby these fabrics can have different thicknesses, depending on the purpose of use of the sock.

It should be noted at this point that ski socks that use different fabrics in the direct area of the foot, on the one hand, and in the tower calf area, on the other, for example, are already known. It is also known to provide padded cushions or reinforcements in the area of the shins, in order to achieve a better padding in the ski boot or in the football shoe, for example.

Further advantages and specific details of the invention proceed from providing paddings of climate-adjusting fabrics in the area of the calf, for example, which can be arranged in rod-shaped, arched, helical, or in other ways, such as a calf-shaped structure or the like.

One exceptional feature of the sock in accordance with the invention can, in an additional configuration, also consist, of the fact that it is equipped, in an integrated X-cross support band, with an elastic fabric band, whereby this elastic fabric band consists of climate-adjusting fabric.

For the formation of an automatically-shaped bed of the foot which takes the differing stresses on the sole of the human foot into consideration, the invention provides for padded cushions or paddings in the area of the toes, the ball of the foot, and/or the heel.

In addition, it can be advantageous to provide a corrugated stretch fabric in the area of the instep, at least in some areas, also with climate-adjusting fabrics of the type of corrugated knit fabric. In this type of knit fabric, the fabric does not lie completely on the skin, as the result of which more air can reach the skin. At the same time, it is brought about, through the type of corrugated knit fabric, that the fabric has a higher elasticity and thereby prevents the formation of folds within the sock, as well as the sliding of the foot within the sock or shoe, which leads to the fact that, the formation of blisters comes about less frequently.

BRIEF DESCRIPTION OF THE DRAWINGS

The invention will be illustrated in further detail in the following drawing which depict the following:

FIG. 1 is a side view of an example of implementation of a sock in accordance with the invention;

FIGS. 2–7 are alternative examples of implementation of socks for different purposes of use; and;

FIG. 8 is a side view, similar to FIG. 1, of an additional example or implementation.

DETAILED DESCRIPTION OF THE INVENTION

In reference to FIG. 1, the sock in accordance with the invention, which is designated as a whole by (1), has an air channel (3) proceeding from the sole of the foot which channel is indicated by the arrow (2) and extends up to the band (4), and is formed of climate-adjusting net-type knit fabric. Through this air channel (3), moisture is drawn off from the area of the sole of the foot in an upward direction. Such a type of air channel (3) can also be provided on the inside surface of the sock, which is not discussed in further detail here.

In the interior of the sock, the sock (1) is equipped with a padded instep cushion or padding (5) and, in the area of the shin, it is equipped with a padded shin cushion (6), whereby the corresponding contours are only indicated in dotted form.

Both the padded instep cushion (5) and the padded shin cushion (6) are of climate-adjusting fabric, whereby different thicknesses of fabric can be provided here.

The area of the Achilles tendon is also protected by means of a padded cushion (7). In order to prevent grazing and blisters, which can be brought about in this area through the friction from the upper edge of the shoe, this padded cushion (7) also consists of a climate-adjusting fabric. Examples of suitable climate-adjusting fabrics are COOLMAX fabric and THERMASTAT fabric, both made by E.I. duPont de Nemours and Company.

As is evident from the figures, the area of the calf is also provided with padded cushions whereby, in the example depicted, rod-type paddings (8) are provided. The invention is not, in any event, restricted to this form of configuration, and other forms, such as an arched shape or the like, can also be provided here.

As can be seen from the figures, the sock (1) is also provided with an X-cross support band (9) which is formed of an elastic, climate-adjusting fabric, and which supports the motion apparatus in the transitional area between the leg and the foot.

In order to guarantee an anatomically-formed that bed, the sole of the sock is equipped with additional padded cushions or paddings (10 and 11), particularly in the area of the heel and in the area of the ball of the foot and/or in the area of the toes.

Variants of examples of implementation of the sock in accordance with the invention are depicted in FIGS. 2 to 7. Thus, FIG. 2 depicts a tennis sock with an X-cross support band; FIG. 3 depicts a sock for everyday use, whereby the ankle joint is supported; FIG. 4 depicts a shoe for cyclists; FIG. 5 depicts the ski sock reproduced on a larger scale than in FIG. 1; FIG. 6 depicts a running sock; and FIG. 7 depicts a sock specially designed for skaters. The padded cushion fabric, the paddings, and the other configurations are slightly modified relative to the example of implementation in accordance with FIG. 1, whereby the X-cross support bandaging of the ankle joint, among others, is also in the foreground here.

Additional support bands are depicted in FIG. 8; thus, there is a ring-type support band (12) above the ankle and, below that, an additional support bandaging (13), whereby these support bandagings can have different types of extension and elasticities. It is additionally depicted that a diagonal support bandaging (14) supporting the sole of the foot between the ball of the foot and the heel, which leads to an increased comfort during running and wearing in many cases, can be provided.

It should be additionally noted at this point that the paddings of the sock can consist of hollow-core fibers which are coated with threads of wool or cotton. The hollow-core/plastic threads are particularly effective in damping shocks and pressure. The hollow core fibers provide insulating air space within the fibers and one specific example is THERMAX fabric of E.I. duPont de Nemours and Company.

The bed of the foot is knit from ensheathed micro-fibers, which are extremely supple and reduce the abrasion/skin abrasion. Depending on the requirements, the bed of the foot is 100% micro-fibers, even in the area of the toes and the heel. The Achilles tendon protective pad, which is made of plastic threads or compound fabric and threads or other materials, serves to protect the Achilles tendon. In order to achieve a high stability, the support bands are also woven, or knit, from non-elastic and elastic threads.

The net or mesh-type fabric/knit fabric within the 'Air Channel' consists of climate-adjusting hollow-core plastic threads, which are also ensheathed by other plastic, such as nylon or spandex, wool and/or cotton threads. A moisture-absorbing and moisture-transport fabric/knit fabric is brought about by this compound thread. The net or mesh-type knit fabric/knit fabric ('Air Channel') does not completely cover the skin but, instead, depending on the requirements, leaves portions of tile skin uncovered, so that drops of sweat can arise on the skin, which then drip onto the net or mesh fabric and are transported away or wicked away from the same. An increased cold/cooling from evaporation is (hereby brought about, Micro-fiber, polyester, and acrylic paddings within the different zones of the foot bring about mechanical, thermal release, or damping and insulation.

In one example, a sock can be made from COOLMAX® or TACTEL® fibers enclosed in cotton. TACTEL is a product of Imperial Chemical Industrial PLC. Polyester fiber can be added for shock absorbency and elasticity. In another example, the sock could be made from COOLMAX® or THERMASTAT fibers blended with merino wool or silk. In yet another example, KEVLAR® (an aromatic polyamide fiber made by E.I. duPont de Nemours and Company) enhanced with a microfiber and cotton are used. A synthetic fiber, such as LYCRA® (a spandex fiber in the form of continuous monofilaments made by E.I. duPont de Nemours and Company) may be added to provide for elasticity.

The example of implementation of the invention can, of course, be further modified in various ways without departing from its fundamental concept. Thus, the sock can be formed as a left and a right sock, the configuration of the padded cushion can diverge from the one depicted here, and the like.

What is claimed is:

1. A climate-adjusting sock (1) having foot portion with a sole, an intermediate portion extending therefrom, and a band at the top thereof, with padding provided in predetermined areas, for use in various types of leisure sports activities, characterized by at least one integrated air channel (3), of a climate-adjusting net-type knit fabric, which extends from the sole of the foot (2) up to the band (4) for drawing off moisture from the sole area.

2. A climate-adjusting sock in accordance with claim 1, characterized in that, the air channel (3) is provided on both outer sides of the sock (1).

3. A climate-adjusting sock in accordance with claim 2, characterized in that, the intermediate portion of the sock in the area of the ankle is equipped with an integrated X-cross support band (9) of an elastic fabric band of climate-adjusting fabric for supporting the ankle.

4. A climate-adjusting sock in accordance with claim 2, characterized in that, the sock (1) is equipped, at least in the area of the instep of the sole, with a padded cushion (5) or padding of climate-adjusting fabric.

5. A climate-adjusting sock in accordance with claim 4, characterized by a corrugated stretch fabric in the instep area of the sole, whereby the corrugated fabric is formed as a climate-adjusting fabric of the corrugated knit fabric type.

6. A climate-adjusting sock in accordance with claim 5, characterized in that, the sock is equipped with a padded cushion (6, 7) or padding of climate-adjusting fabric in the area of the Achilles tendon.

7. A climate-adjusting sock in accordance with claim 6, wherein a padded cushion of climate-adjusting fabric is provided in the area of the shin.

8. A climate-adjusting sock in accordance with claim 6, characterized in that, the calf area of the sock is equipped with padded cushions (8) of climate-adjusting fabric.

9. A climate-adjusting sock in accordance with claim 8, characterized in that, the padded cushions (8) of the calf area are configured as rods, arches, or spirals.

10. A climate-adjusting sock in accordance with claim 1, rods, arches, or spirals. characterized in that the intermediate portion of the sock is provided in the area of the ankle with an integrated X-cross support band (9) of an elastic fabric band of climate-adjusting fabric for supporting the ankle.

11. A climate-adjusting sock in accordance with claim 10, characterized in that the sole of the sock is provided with an anatomically formed foot bed, which is formed by padded cushions in the area of the toes and the heel.

12. A climate-adjusting sock (1) having a foot portion with a sole, an intermediate portion extending therefrom, and a band at the top thereof, with padding provided in various areas, for use in various types of leisure sport activities, characterized in that the intermediate portion of the sock in the area of the ankle is equipped with an integrated X-cross support hand (9) of an elastic fabric band of climate-adjusting fabric for supporting the ankle.

13. A climate-adjusting sock in accordance with claim 12, characterized in that, the sole of the sock is provided in the area of the ankle with an anatomically-formed foot bed which is formed by padded cushions (11, 10) or paddings in the area of the toes and the heel.

14. A climate-adjusting sock in accordance with claim 13, characterized in that, the padded cushions (5) are formed of hollow-core fibers, which are coated with threads of wool or cotton.

15. A climate-adjusting sock in accordance with claim 14, characterized in that, the foot bed of the sole is knit from ensheathed micro-fibers.

16. A climate-adjusting sock in accordance with claim 15, characterized in that, the padded cushion (7) is, in the area of the Achilles tendon, formed from plastic threads and/or a compound fabric.

17. A climate-adjusting sock in accordance with claim 16, characterized in that, the sock is provided, in the area of the ankle joint, with at least one encircling support bandaging.

18. A climate-adjusting sock in accordance with claim 17, characterized in that, the area of the sole of the foot is provided with a diagonal support fabric.

19. A climate-adjusting sock (1) having a foot portion with a sole, an intermediate portion extending from the sole and a band at the top of the intermediate portion, with padding provided in predetermined areas of the sock, for use in various types of leisure sports activities, characterized by at least one air channel (3), of a climate-adjusting net-type fabric, which extends from the area of the sole upwardly into the intermediate portion toward the band for drawing off moisture from the sole area.

20. A climate-adjusting sock in accordance with claim 19, characterized in that the intermediate portion of the sock in the area of the ankle is provided with an integrated X-cross support band (9) of an elastic fabric hand of climate-adjusting fabric for supporting the ankle.

* * * * *

UNITED STATES PATENT AND TRADEMARK OFFICE

CERTIFICATE OF CORRECTION

PATENT NO. : 6,286,151 B1
DATED : September 11, 2001
INVENTOR(S) : Lambertz

It is certified that error appears in the above-identified patent and that said Letters Patent is hereby corrected as shown below:

Column 1,
Line 37, change “white” to -- while --.
Line 58, change “tower” to -- lower --.

Column 2,
Line 32, change “or” to -- of --.
Line 38, after “foot” insert -- , --.

Column 3,
Line 6, change “that” to -- foot --.
Line 58, change “tile” to -- the --.
Line 62, change “(hereby” to -- thereby --.
Line 62, change the “,” after “about” to -- . --.

Column 4,
Line 55, delete “rods, arches or spirals”.

Column 5,
Line 2, change “hand(9)” to -- band (9) --.

Column 6,
Line 17, change “fabric hand” to -- fabric band --.

Signed and Sealed this

Eighteenth Day of January, 2005

JON W. DUDAS
*Director of the United States Patent and Trademark Office*